United States Patent [19]

Otala

[11] 4,256,991

[45] Mar. 17, 1981

[54] ELECTRONIC IGNITER FOR FLUORESCENT LAMPS

[75] Inventor: Matti N. T. Otala, Oulu, Finland

[73] Assignee: Otamation Oy, Oulu, Finland

[21] Appl. No.: 37,490

[22] Filed: May 10, 1979

[30] Foreign Application Priority Data

May 17, 1978 [FI] Finland ..... 781562

[51] Int. Cl.[3] ..... H05B 41/00; H05B 41/14

[52] U.S. Cl. ..... 315/104; 315/100; 315/209 PZ; 310/339

[58] Field of Search ..... 315/100, 101, 103, 104, 315/106, 209 PZ; 361/260; 310/339, 315

[56] References Cited

U.S. PATENT DOCUMENTS

| | | | |
|---|---|---|---|
| 3,136,355 | 6/1964 | Weber | 361/260 |
| 3,886,401 | 5/1975 | Berg | 315/100 |
| 4,082,985 | 4/1978 | Bolhuis | 315/209 PZ |

*Primary Examiner*—Alfred E. Smith
*Assistant Examiner*—Thomas P. O'Hare
*Attorney, Agent, or Firm*—Shenier & O'Connor

[57] ABSTRACT

Methods and apparatus for electronically igniting gas discharge lamps, such as hot- or cold-cathode fluorescent lamps, various high-pressure, metal-gas, and halogen-gas lamps.

The initial heater current, in the case of hot-cathode lamps, or the initial high voltage across the unignited lamp, in the case of cold-cathode lamps, is used to heat a positive temperature coefficient resistor. The heat generated by this resistor causes a striker mechanism, consisting in essence of a pre-tensioned bi-metal disc or strip, to buckle, the said buckling striking a piezo-electric crystal, thereby inducing a high voltage, which ignites the lamp.

Various coupling circuits between the mechanism and the lamp are described.

The important features, compared to presently known igniters relate to the flickerless and reliable ignition of the lamp, more reliable igniter structure, and lengthened life time of the lamps.

10 Claims, 7 Drawing Figures

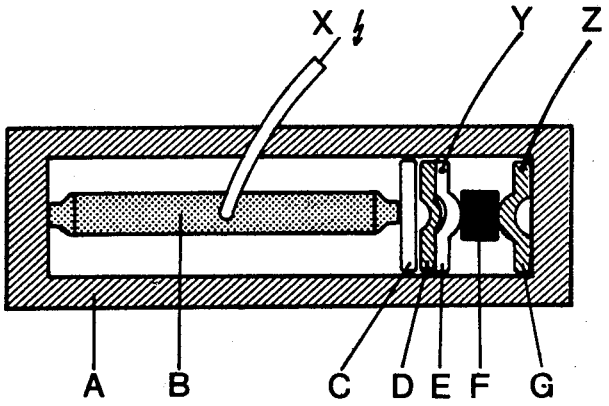
FIG.3
FIG. 4A
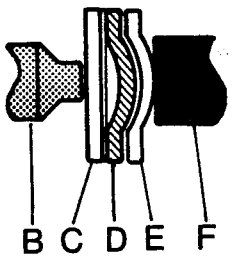
FIG. 4B
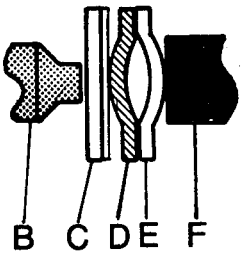

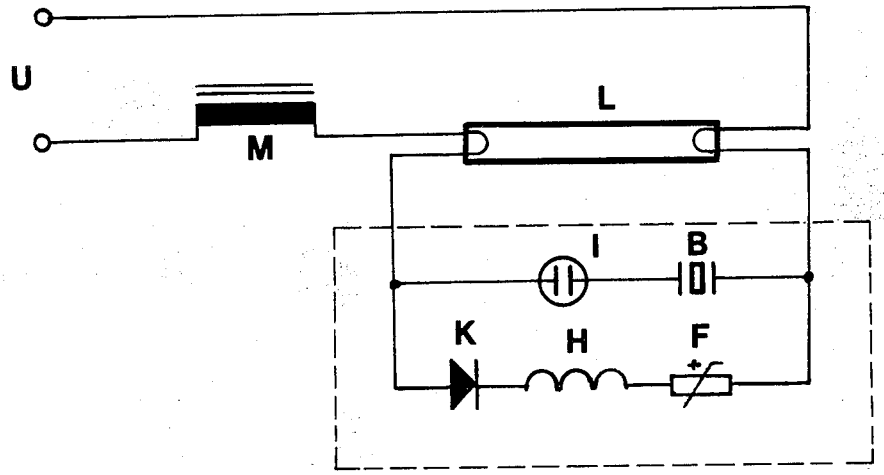
Figure 5
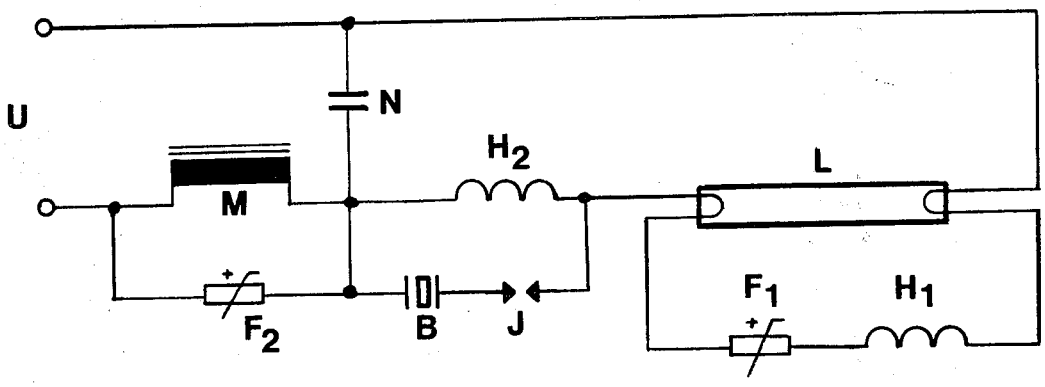
Figure 6
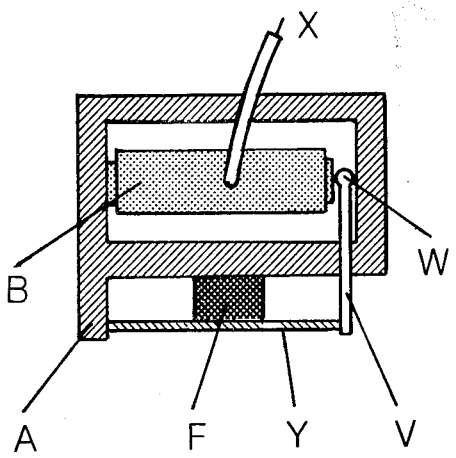

ELECTRONIC IGNITER FOR FLUORESCENT LAMPS

This invention relates to methods and apparatus for igniting gas discharge lamps used for illumination purposes; and providing adequate pre-heating of the cathode(s) in the case of hot-cathode lamps. The method and its embodiments incorporate the combination of piezo-electric crystals (PE), positive temperature coefficient (PTC) resistors, and bi-metal structures. In addition to these, the various practical realizations of the invention make additional use of semiconductor diodes, coils, and capacitors.

In normal, present installation, a hot-cathode fluorescent lamp is ignited with a separate glow starter S, as shown in FIG. 1. When the mains voltage U is applied to the lamp L, the full voltage across the unignited lamp causes a glow discharge in the starter S, thereby heating its electrodes. This heating causes one of the electrodes, made out of a pre-distorted bi-metal strip, to buckle and short-circuit the starter S. A current will now flow through the circuit formed by ballast M, and the cathodes of the fluorescent lamp L.

Since the starter S was short-circuited, no further heat is generated in it, an it cools down. After a few seconds, its contacts open again. The rapid change in the current in ballast M creates a voltage transient across the lamp L, thereby exceeding the ignition voltage of the lamp, and leaving it permanently ignited. Since the burning voltage of the lamp L is considerably smaller than the ignition voltage, or the mains voltage, no further glow discharge can be created in the starter S, which thereafter remains inactive. Capacitor N is sometimes used to augment the ignition, as it increases the current surge through the lamp L in the initial phase of the ignition.

The igniting method described above has several disadvantages:

i Ignition takes several seconds.

ii If the bi-metal contact of the starter S opens at a moment, when the current in the ballast is zero, no voltage transient is generated, and the ignition sequence will start again. This creates serious flicker during the ignition.

iii If the mains voltage is connected to the lamp fixture at a suitable moment, when it is at maximum, the lamp may ignite due to field emission, the cathodes still being cold. This will severely shorten the lifetime of the lamp.

iv When the lamp gets older, its ignition voltage increases. At a given moment, it does not ignite anymore, which leads to violent flickering, and finally to the destruction of the starter.

The invention is described in detail below with reference to the drawings wherein:

FIG. 3 illustrates the structural configuration of the igniter of FIG. 2.

FIGS. 4A and 4B show the positions of the bi-metal elements of FIG. 3 under different temperature conditions.

FIG. 5 is a schematic representation of a second embodiment of the invention.

FIG. 6 is a third embodiment of the invention.

FIG. 7 illustrates a modification of the igniter used in the present invention.

Figure 2:
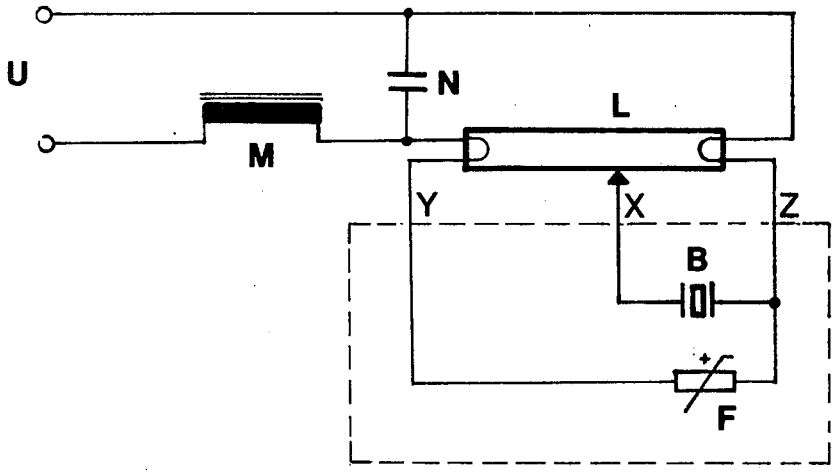
FIG. 2 illustrates schematically a first embodiment of the invention.

The invention described in the following will eliminate these disadvantages. In its simplest embodiments, the invention is shown in FIGS. 2 and 3. All the Figures, and the explanations, refer to the use of the invention with hot-cathode fluorescent lamps. However, the invention is equally applicable to cold-cathode gas discharge lamps, with only minor modifications.

In FIG. 2, a PTC resistor F is connected between the cathodes of the fluorescent lamp L, and a conducting wire leading from a PE crystal B is pressed against the lamp wall. The mechanical interconnection of the PTC resistor, and the PE crystal, is depicted in FIG. 3. The structure is composed for instance of a straight washer C, and of a washer E, onto which a cup-formed dent has been embossed. In addition to the components named above, the structure incorporates two bi-metal washers D and G, which also have been pre-formed to have the shape of a small cup.

The operation of the individual components is as follows:

1. The resistance of the PTC resistor is typically 50–100 ohm in the temperature range 0° C. through 100° C. When the temperature increases over 105° C., the resistance increases very steeply, and is typically 100–500 kilo-ohms in the temperature of 120° C.
2. Bi-metal cup D is in the position shown in FIG. 4A up to the temperature of 100° C. When the temperature exceeds this value, it buckles into the position shown in FIG. 4B.
3. When PE crystal B is pressed, it develops a very high voltage, typically 20–30 kilovolts, across its terminals.

The functioning of the igniter structure is as follows:

1. When mains voltage U is connected, the PTC resistor F is cold. Therefore a large current flows through it, and through the cathodes of the fluorescent lamp L. This current heats the cathodes, and the PTC resistor, which in turn heats bi-metal parts D and G.
2. When the PTC resistor F attains the temperature of about 110° C., bi-metal cup D buckles, and presses PE crystal B.
3. The PE crystal now creates a high voltage, which induces a capacitive field discharge inside the fluorescent lamp L, thereby igniting it.
4. When the lamp ignites, the PTC resistor F has attained its high-resistance state, and only an exceedingly small current flows through it.
5. Since the thermal contact between the bi-metal cup D, and the PTC resistor F worsened due to the buckling, cup D cools down, and buckles back to its original position.
6. If the fluorescent lamp L was ignited by the voltage of the PE crystal B, the burning voltage across the lamp is much lower than during the previous ignition sequence. This lowers the temperature of the PTC resistor F so that the bi-metal cup D does not buckle again.
7. If the lamp L was not ignited, the bi-metal cup buckles back and forth, thereby continuously creating ignition pulses to the lamp. If, however, the lamp does not ignite in 10–20 seconds, the heat generated in the PTC resistor F heats up the whole igniter body A. A second bi-metal cup G, having a good thermal contact with the igniter body A, buckles now, decreasing the base pressure loading of bi-metal cup D, thereby preventing it from buckling back. As a consequence, cup D remains in the position shown in FIG. 4B, and the ignition procedure is interrupted, while the PTC resistor F remains in its high-resistance state, thereby decreasing the current through the cathodes of lamp L to a very low value.

Further developments of the igniter are shown in FIGS. 5 and 6. The circuit of FIG. 5 incorporates two improvements:

1. The wire contact to the body of the lamp has been removed, and the voltage delivered by the PE crystal B is brought to the cathodes of lamp L. In order not to short-circuit this voltage, it is fed to the cathodes via a miniature glow discharge lamp I, so that the ignition voltage is applied as a very short, energetic pulse, the short-circuiting of which is prevented by coil H.
2. A semiconductor diode K is connected in series with the PTC resistor, causing a rectification of the current through the cathodes. The DC component causes magnetic saturation of the iron core of the ballast M, significantly increasing the start-up current, and thereby decreasing the time needed for pre-heating of the cathodes.

Further improvements are depicted in FIG. 6. The PE crystal is connected in series with the fluorescent lamp L using a minute spark gap J, and coil $H_2$. The use of capacitor N, improving the ignition, and decreasing radio interference, is now possible.

Another PTC resistor $F_2$ is connected across ballast M. The purpose of this component is to increase the start-up current, thereby decreasing the ignition time, and also to warm PTC resistor $F_1$ to further increase its resistance after the fluorescent lamp has ignited. To assure good thermal contact, both PTC resistors are mounted mechanically together. For best operation, it is advisable to select the critical temperature of PTC resistor $F_2$ to be 10°–15° C. higher than that of PTC resistor $F_1$.

In the circuits shown in FIGS. 2, 5 and 6, it may be advantageous to use mechanical lever action between the bi-metal and PE crystal parts to adjust the relatively small compressibility of a PE crystal to the relatively large buckling movement of the bimetal cups. The basic operating principle of the igniter remains, however, exactly same.

The same basic embodiments of the invention can also be used to ignite cold-cathode gas discharge lamps. In the previous circuits, it only suffices to replace the cathode(s) of the fluorescent lamp L with a short circuit.

Figure 1:
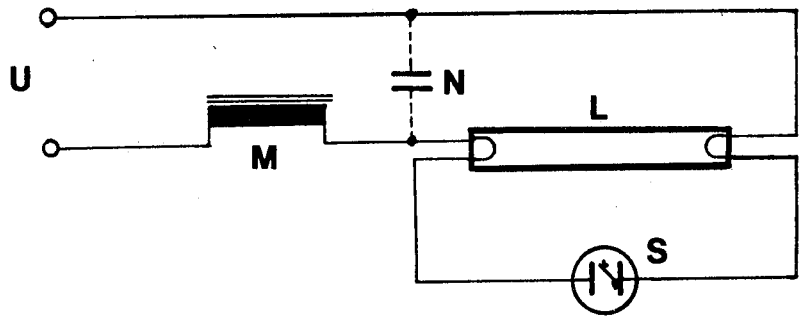
Figure 1 (Prior Art)
FIG. 1 illustrates a prior art fluorescent lamp ignited with a separate glow starter.

FIG. 7 illustrates an example of this kind of modification. The elements are otherwise similar to those described in FIG. 1, except for a lever V, which in equipped with an eccentric axle W. The buckling of a preformed bimetal strip Y by the heat generated in the PTC resistor F, causes the lever to move, thereby turning the axle W, which then compresses the piezo-electric crystal B.

It will be understood that modifications and variations may be effected without departing from the spirit and scope of the novel concepts of this invention.

I claim as my invention:

1. Apparatus for igniting a gas discharge lamp from a source of voltage including in combination, a piezoelectric crystal adapted to be activated to produce a high voltage pulse, striker means for actuating said crystal, said striker means including a bi-metallic member which rapidly changes physical shape in response to heating thereof, means including a positive temperature coefficient resistor for heating said bi-metallic member, means for connecting said source of potential to said resistor to heat said bi-metallic member to activate said crystal, and means for applying the resultant high voltage pulse to said lamp.

2. Apparatus as in claim 1 in which said pulse applying means applies said pulse to the side of said lamp to cause a capacitive ignition of the lamp.

3. Apparatus as in claim 1 including means for mechanically assemblying said resistor and said bi-metallic element in a series structure which buckles back and forth as said element heats up and cools down.

4. Apparatus as in claim 1 including means comprising a second bi-metallic structure for changing condition after a predetermined time to render the remainder of said assembly inoperative.

5. Apparatus as in claim 1 in which said means for applying said voltage to said resistor includes a semiconductor diode connected in series with said resistor.

6. Apparatus as in claim 1 including a ballast coil for said lamp, a second positive temperature coefficient resistor and means connecting said second positive temperature coefficient resistor across said ballast coil to accelerate the ignition process and to decrease the residual current through the first positive temperature coefficient resistor.

7. Apparatus as in claim 1 including a glow discharge lamp for converting said crystal static voltage to a rapid voltage transient.

8. Apparatus as in claim 1 including spark gap means for converting said crystal static voltage to a rapid voltage transient.

9. Apparatus as in claim 1 including a coil in series with said resistor for preventing short circuiting of said crystal pulse.

10. Apparatus as in claim 1 including a coil in parallel with said crystal for preventing short circuiting of the crystal pulse.

* * * * *